US005246335A

United States Patent [19]

Mitsubori et al.

[11] Patent Number: 5,246,335

[45] Date of Patent: Sep. 21, 1993

[54] COMPRESSOR CASING FOR TURBOCHARGER AND ASSEMBLY THEREOF

[75] Inventors: Ken Mitsubori, Yokohama; Fusayoshi Nakamura, Ichikawa; Kaoru Aso, Kasukabe; Hiromu Furukawa, Kurihashi; Kazuhiro Onizuka, Yokohama; Akira Iwakami, Tokyo; Nobuhiro Kondo, Noda; Hiroshi Yamaguchi, Nagareyama; Tateo Sakimoto; Satoshi Yamaguchi, both of Yokohama, all of Japan

[73] Assignee: Ishikawajima-Harimas Jukogyo Kabushiki Kaisha, Tokyo, Japan

[21] Appl. No.: 869,181

[22] Filed: Apr. 16, 1992

[30] Foreign Application Priority Data

May 1, 1991 [JP] Japan ..... 3-040191[U]
Sep. 2, 1991 [JP] Japan ..... 3-246518
Sep. 6, 1991 [JP] Japan ..... 3-254140

[51] Int. Cl.[5] ..... F04D 29/42

[52] U.S. Cl. ..... 415/58.3; 415/214.1; 415/914

[58] Field of Search ..... 415/11, 58.2, 58.3, 415/58.4, 182.1, 914, 196, 213.1, 214.1

[56] References Cited

U.S. PATENT DOCUMENTS 2,470,565 5/1949 Loss .
3,489,340 1/1970 Holzhausen ..... 415/196
4,479,755 10/1984 Skoe .
4,676,717 6/1987 Willyard, Jr et al. .
4,693,669 9/1957 Rogers, Sr. .
4,743,161 5/1988 Fisher et al. .
4,930,978 6/1990 Khanna et al. ..... 415/58.3
4,990,053 2/1991 Rohne ..... 415/58.4

FOREIGN PATENT DOCUMENTS 0122328 10/1984 European Pat. Off. .
0229519 7/1987 European Pat. Off. .
0348674 1/1990 European Pat. Off. .
3728929A1 5/1989 Fed. Rep. of Germany .
178014 3/1966 U.S.S.R. .
0850928 7/1981 U.S.S.R. ..... 415/11
1132485 11/1968 United Kingdom .
2202585 9/1988 United Kingdom .
2220447A 1/1990 United Kingdom .
92/03660 3/1992 World Int. Prop. O. .

*Primary Examiner*—Edward K. Look
*Assistant Examiner*—Christopher Verdier
*Attorney, Agent, or Firm*—Oblon, Spivak, McClelland, Maier & Neustadt

[57] ABSTRACT

A compressor casing defines an air inlet port, an air intake passage with an impeller accommodated therein, a diffuser and a scroll all communicated with each other in the order named. An annually extending chamber is formed between the passage and the scroll and has an opening opened sideways of the impeller in the passage, enhancing an ability of discharging a surging-occuring range to a lower flow rage. The compressor casing may be divided into a casing main body and an inner casing so as to decrease fabrication cost of the compressor casing.

5 Claims, 14 Drawing Sheets

COMPRESSOR CASING FOR TURBOCHARGER AND ASSEMBLY THEREOF

BACKGROUND OF THE INVENTION

The present invention relates to a compressor casing for a turbocharger and an assembly thereof.

Generally as shown in FIG. 1, a turbocharger utilizes exhaust gas 2 from an engine 1 to drive a turbine 3 which in turn drives a compressor 4 coupled through a common shaft with the turbine 3, thereby charging compressed air 5 into the engine 1.

The compressor 4 comprises, as shown in FIG. 2, an integrally cast compressor casing 10 which defines an air inlet port 6, an air intake passage 7 extending from the port 6, a diffuser 8 extending radially from an outlet end of the passage 7 and a scroll 9 extending to surround over outer surfaces of the diffuser 8 and passage 7, all of which are communicated with each other in the order named. An impeller 11 is rotatably accommodated in the passage 7 and its rotation by the turbine 3 will cause the air 5 to be sucked through the port 6 into the passage 7, increased in pressure while flowing through the diffuser 8 and charged through the scroll 9 into the engine 1.

With the compressor 4 described above, in a low flow rate range where the volume of intake air 5 is small, the air 5, increased in pressure by the diffuser 8, may flow back or reverse, causing low-noise vibrations called surging. In order to prevent such surging or to displace the surge range to a lower flow rate, range, heretofore a ring-shaped space 12 is formed adjacent to the port 6 upon casting of the casing 10 so as to open to the port 6 and surround the passage 7. A ring-shaped groove 13 or a plurality of through holes are machined through the casing 10 such that the groove 13 extends from the passage 7 to an innermost portion of the space 12, thereby defining an air passage 14 for the discharge therethrough of reversing air 5.

Reference numeral 15 denotes reinforcing ribs arranged circumferentially of the space 12. Upon driving of the engine with a low volume of intake air, the reversing air 5 is permitted to flow out of the passage 14 and upon driving of the engine with a high volume of intake air, the air 5 is charged also through the passage 14 into the engine.

The above-mentioned conventional compressor casing for a turbocharger have problems.

The effect of discharging the reversing air 5 through the passage 14 in the low-intake-air-volume driving so as to displace the surging-occuring range to a lower flow rate range is insufficient since the passage 14 is open to the air inlet port 6 and the intake air flow through the port 6 into the passage 7 suppresses the discharge of the air 5 out of the passage 14. Consequently, the desired capability of displacing the surging-occuring range to a lower flow rate range is insufficiently attained.

Fabrication cost for the compressor casing 10 is high since the casing 10 is integrally cast which has the ring-shaped space 12 defining the air passage 14 and is structurally complicated.

Machining is very much cumbersome since the groove 13 or a plurality of through holes must be machined for communication of the passage 7 with the innermost portion of the space 12.

In view of the above, a primary object of the present invention is to provide a turbocharger compressor casing and its assembly with enhanced ability of displacing the surging-occurring range to a lower flow rate range and with an air passage capable of lowering the casting cost and facilitating the machining.

BRIEF SUMMARY OF THE INVENTION

The present invention provides a compressor casing for a turbocharger having an air inlet port, an air intake passage with an impeller accommodated therein, a diffuser and a scroll all communicated with each other in the order named, which comprises an annually extending chamber between said passage and said scroll, said chamber having a first opening opened sideways of the impeller in the passage.

The chamber may have a second opening extending radially of the impeller which is closer to the air inlet port than the first opening is.

A restriction may be defined by the air intake passage at a position upstream of the opening or openings of the chamber. The restriction is gradually decreased in diameter from the air inlet port toward a wall of the diffuser.

A second restriction may be defined between the openings of the air intake passage.

The present invention also provides a compressor casing assembly for a turbocharger comprising a casing main body and an inner casing fitted with said main body, said main body defining an air inlet port, a portion of an air intake passage, an outer peripheral wall of a scroll and a portion of an inner peripheral wall of said scroll, said inner casing defining a wall of a diffuser, a remaining portion of said inner peripheral wall of said scroll and a remaining portion of said air intake passage. A chamber with an opening sideways of the impeller in the passage is defined at fitted portions of the main body and inner casing; alternatively, an air discharge passage is defined at the fitted portions which communicates a space sideways of the impeller in the passage with a space adjacent to the air inlet port.

The casing main body itself may be divided into an outer casing and a member fitted with said outer casing, said outer casing defining said air inlet port, said outer peripheral wall of the scroll and said portion of the inner peripheral wall of the scroll, said member defining said portion of the air intake passage.

The above-mentioned chamber or air discharge passage may be defined by a recess on the inner casing with an opening communicated sideways of the impeller in the air intake passage and opened to the air inlet port and a restriction-defining member selectively fitted with the main body such that the restriction-defining member closes said recess on the inner casing at the side adjacent to the air inlet port and defines a restriction decreased in diameter from said air inlet port toward said wall of the diffuser.

The present invention will become more apparent from the following description of preferred embodiments thereof taken in conjunction with the accompanying drawings.

DETAILED DESCRIPTION OF THE PREFERRED EMBODIMENTS

Figure 3:
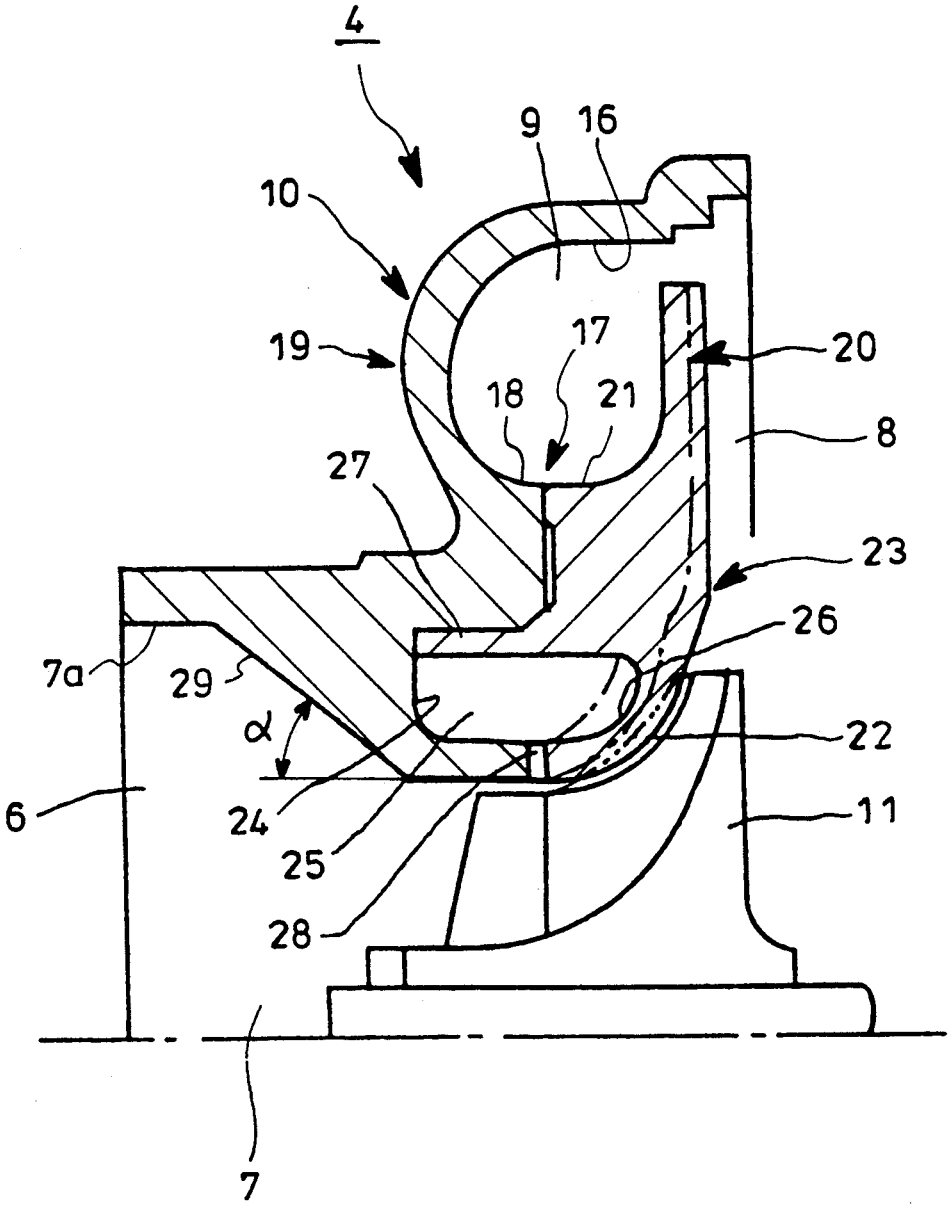
FIGS. 3 to 8 are partial longitudinal sectional views of first to sixth embodiments of the invention, respectively.

Referring first to FIG. 3, a first embodiment of the present invention will be described.

Figure 1:
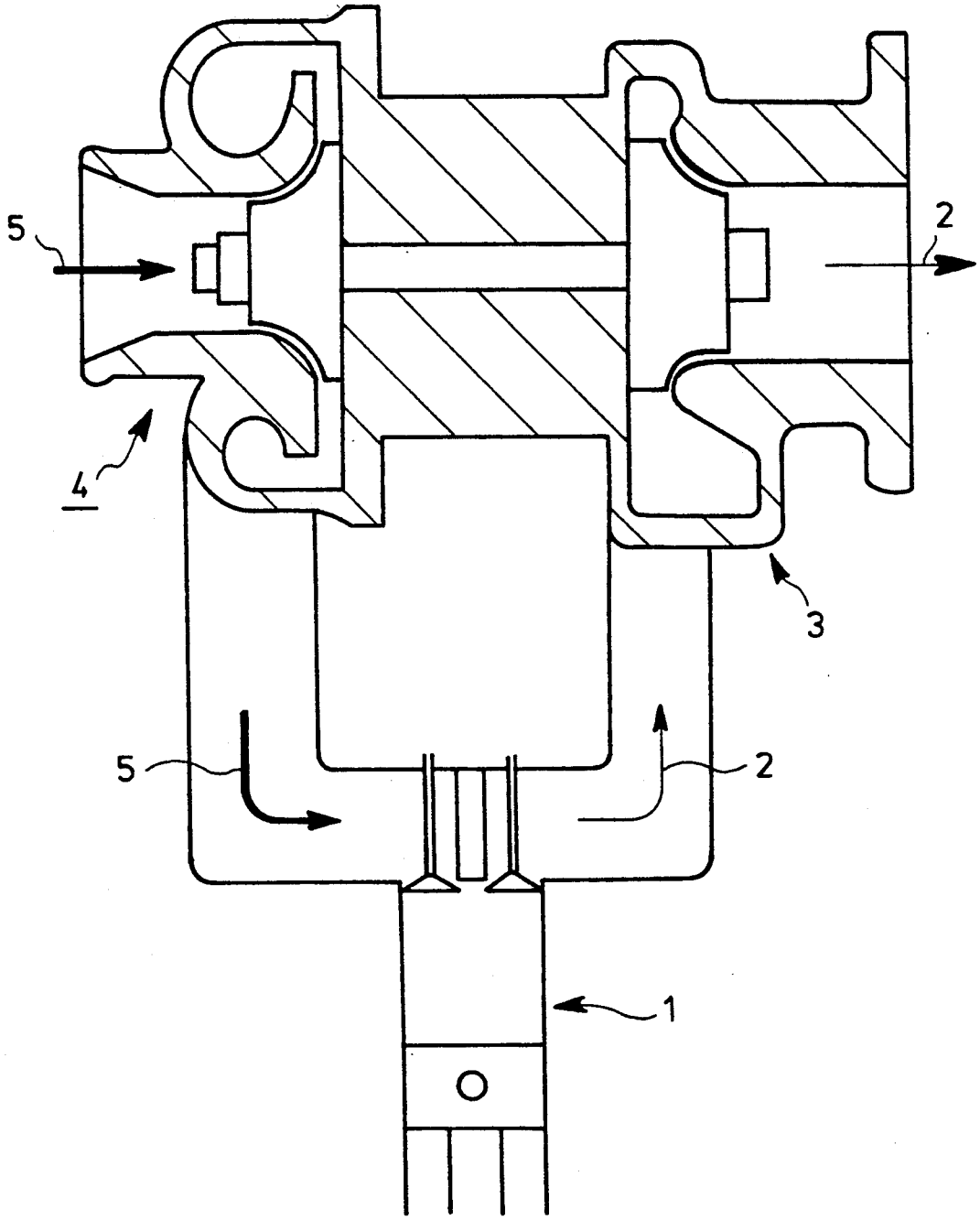
Fig. 1 PRIOR ART
FIG. 1 is a view used to explain a principle of a turbocharger.
Figure 2:
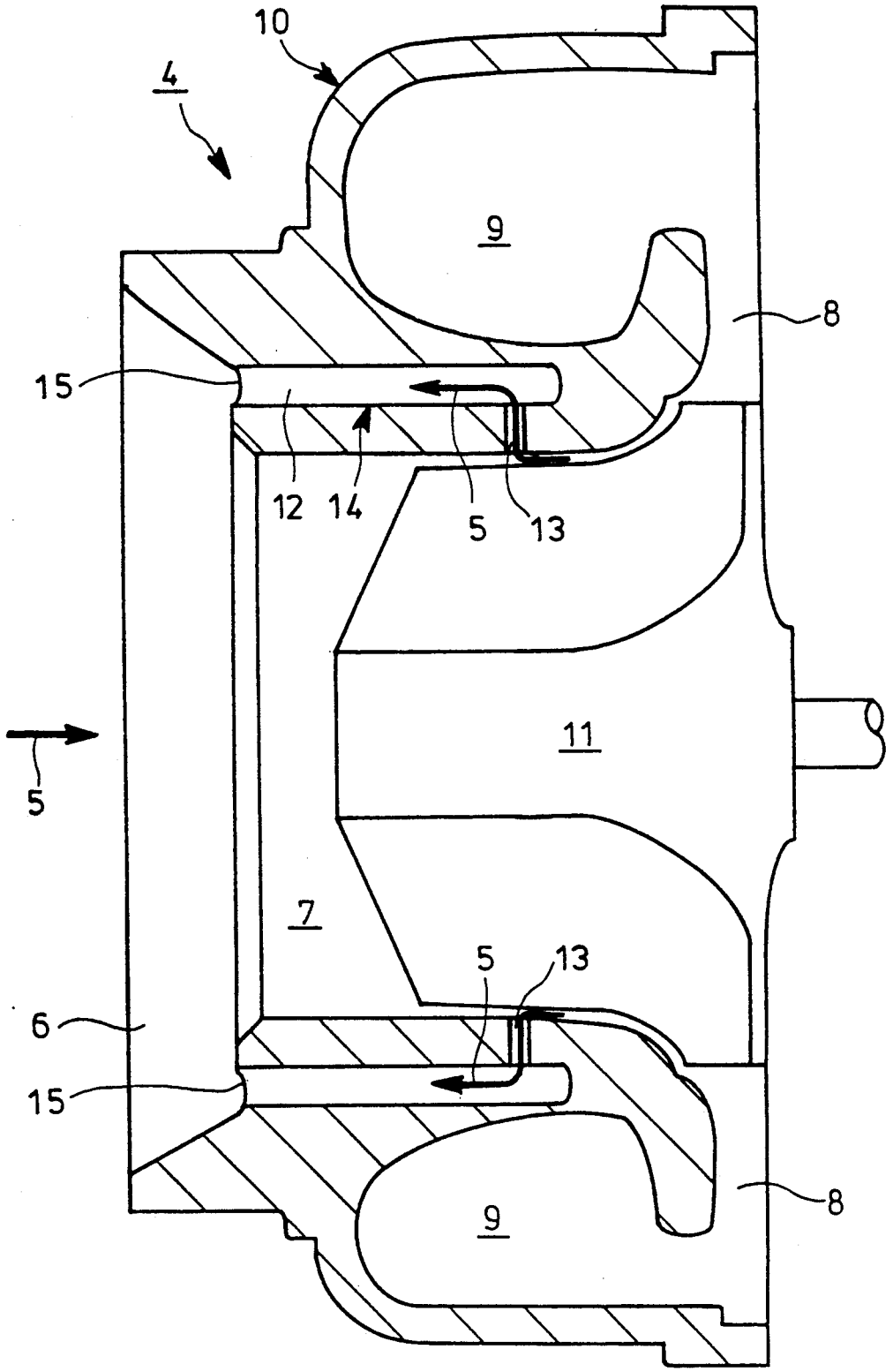
Fig. 2 PRIOR ART
FIG. 2 is a partial longitudinal sectional view of a conventional turbocharger.

Components which are similar to those of the prior art shown in FIGS. 1 and 2 are referred to by the same reference numerals and explanation thereof is omitted.

A casing main body 19 is integrally cast to define the air inlet port 6, an inlet-side portion 7*a* of a wall of the air intake passage 7, an outer peripheral wall 16 of the scroll 9 and a portion 18 of an inner peripheral wall 17 of the scroll 9 contiguous with the wall 16.

A ring-shaped inner casing 23 is also integrally cast to define a diffuser wall 20, a portion 21 of the inner peripheral wall 17 contiguous with the wall 20.

Mutually adjacent ends of the main body 19 and inner casing 21 are respectively formed with ring-shaped recesses 24 and 26 which define together a chamber 25 between them. A projection 27 extending from the inner casing 23 is fitted into an outer wall of the recess 24 of the main body 19 by shrink or cold fitting. A gap is left between the mated casing main body 19 and inner casing 23 so as to define a first opening 28 for intercommunication between the air intake passage 7 and the chamber 25.

A restriction 29 is defined at the passage 7 such that its diameter is gradually decreased from the port 6 toward the diffuser 8. A tapered angle $\alpha$ of the restriction 29 is between 15 and 40 degrees. The first opening 28 is opened sideways of the impeller 11, that is to say, it is slanted so that its lower end in FIG. 3 is downstream of normal fluid flow relative to its upper end.

Next the mode of operation of the first embodiment with the above-described construction will be described.

The process of driving the compressor 4 by the turbine 3 which in turn is driven by the exhaust gas from the engine 1 is substantially similar to the prior art shown in FIGS. 1 and 2 so that explanation thereof is omitted.

The compressor casing 10 is formed with the chamber 25 of a relatively large capacity so that any reversing air 5 which has been increased in pressure by the diffuser 8 in the case of the low-flow-rate driving can escape into the chamber 25 and consequently the surging-occuring range can be displaced to the lower flow rate range.

Because of the chamber 25 being not opened to the air inlet port 6, such escape is not adversely affected by the flow of air 5 from the port 6 into the intake passage 7 and therefore the effect of displacing the surging-occuring range to the lower flow rate range can be obtained.

The escaping effect may be adjusted by varying the capacity and/or shape of the chamber 25.

Because of the compressor casing 10 being divided into the casing main body 19 and the inner casing 23, the shape of the component parts can be simplified, which facilitates the casting and enhances the productivity.

The inner casing 23 can be connected to the casing main body 19 simply by fitting the projection 27 of the inner casing 23 into the outer peripheral wall of the recess 24 of the main body 19 so that, upon shrink or cold fitting, deformations of the wall defining the air intake passage 7 due to the pressure can be substantially eliminated. As a result, the gap between the wall defining the air intake passage 7 and impeller 11 can be maintained smaller so that the satisfactory supercharging efficiency is assured.

Change of the shape of the impeller 11 as, for example, indicated by two-dot-chain lines in FIG. 3 will necessitate reshaping the diffuser wall 20 and the chamber 25 as, for instance, indicated by one-dot-chain lines in FIG. 3. In this case, according to the present invention with the compressor casing 10 being divided into the main body 19 and the inner casing 23, it is not necessary at all to change the design of the overall construction of the casing 10. This makes the casing main body 19 have enough versatility.

Figure 4:
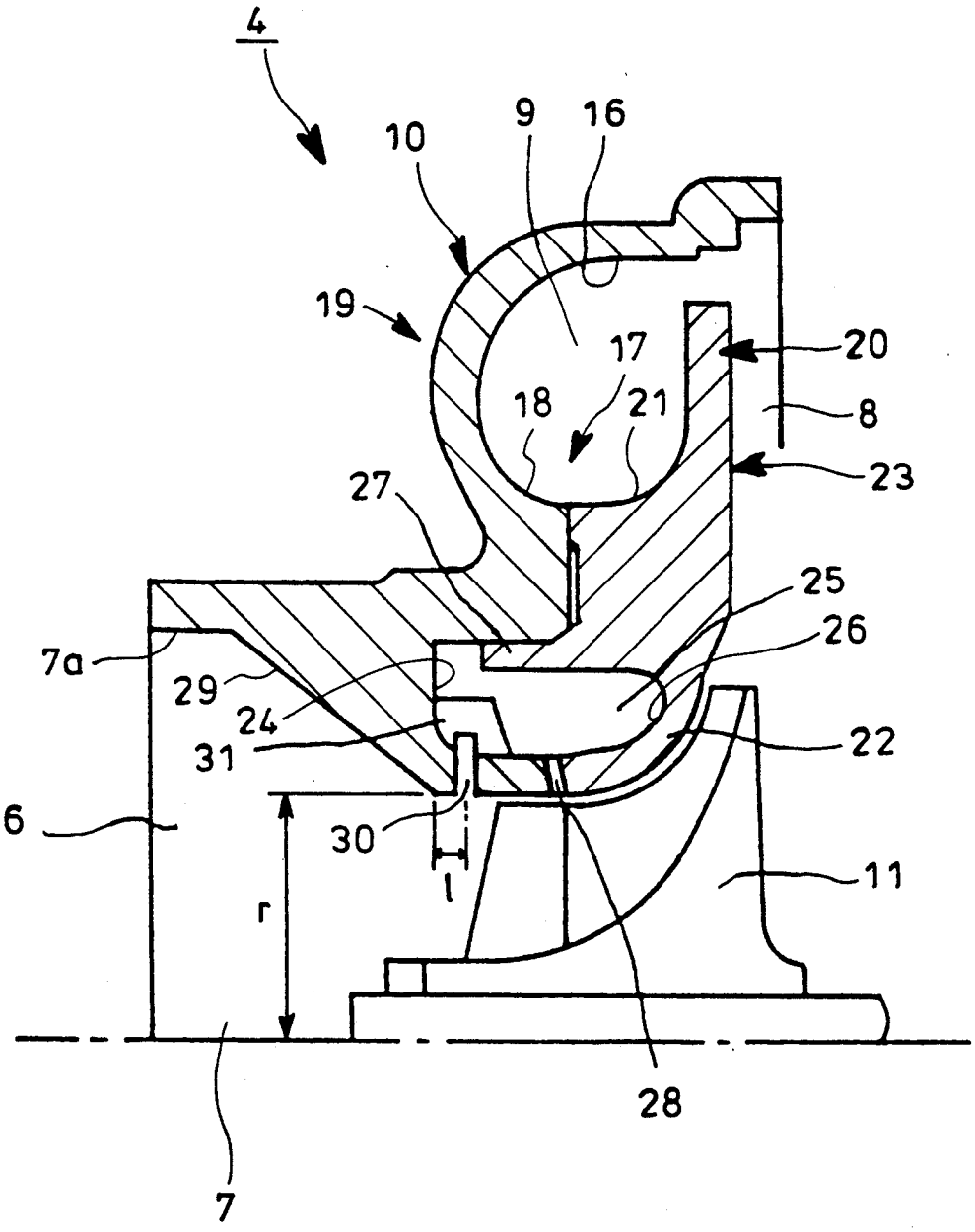

FIG. 4 illustrates a second embodiment of the present invention in which the chamber 25 has a second opening 30 formed adjacent to the air inlet port 6 and extending radially of the impeller 11.

Since the second opening 30 extends radially of the impeller 11, unlike the prior art shown in FIG. 2, escape of the air 5 in the chamber 25 into the intake passage 7 through the second opening 30 is not prevented by the air 5 flowing through the passage 7. On the contrary, the pressure in the chamber 25 becomes negative due to the air 5 flowing through the passage 7 so that the air 5 is sucked into the chamber 25 and smooth flow of the air 5 is ensured. As a result, the effect of displacing the surging-occuring range to the lower flow rate range can be further enhanced.

In addition, because of the restriction 29 at the inlet portion of the air intake passage 7, the air flow 5 therethrough is converged so that the velocity of the air streams adjacent to the wall of the passage 7 is increased and therefore the force for sucking the air 5 within the chamber 25 is further increased.

Except for the above, the second embodiment is substantially similar in construction, mode of operation and features to the first embodiment.

Reference numeral 31 denotes a reinforcing rib formed within the recess 24 of the main body 19. The rib 31 is required when the second opening 30 is in the form of slit and is not necessary in the case of the opening 30 being in the form of hole.

Radius r of the outlet of the restriction 29 and distance 1 from the outlet of the restriction 29 to the second opening 30 (see FIG. 4) must satisfy the following relationship:

$$r > 1$$

Figure 5:
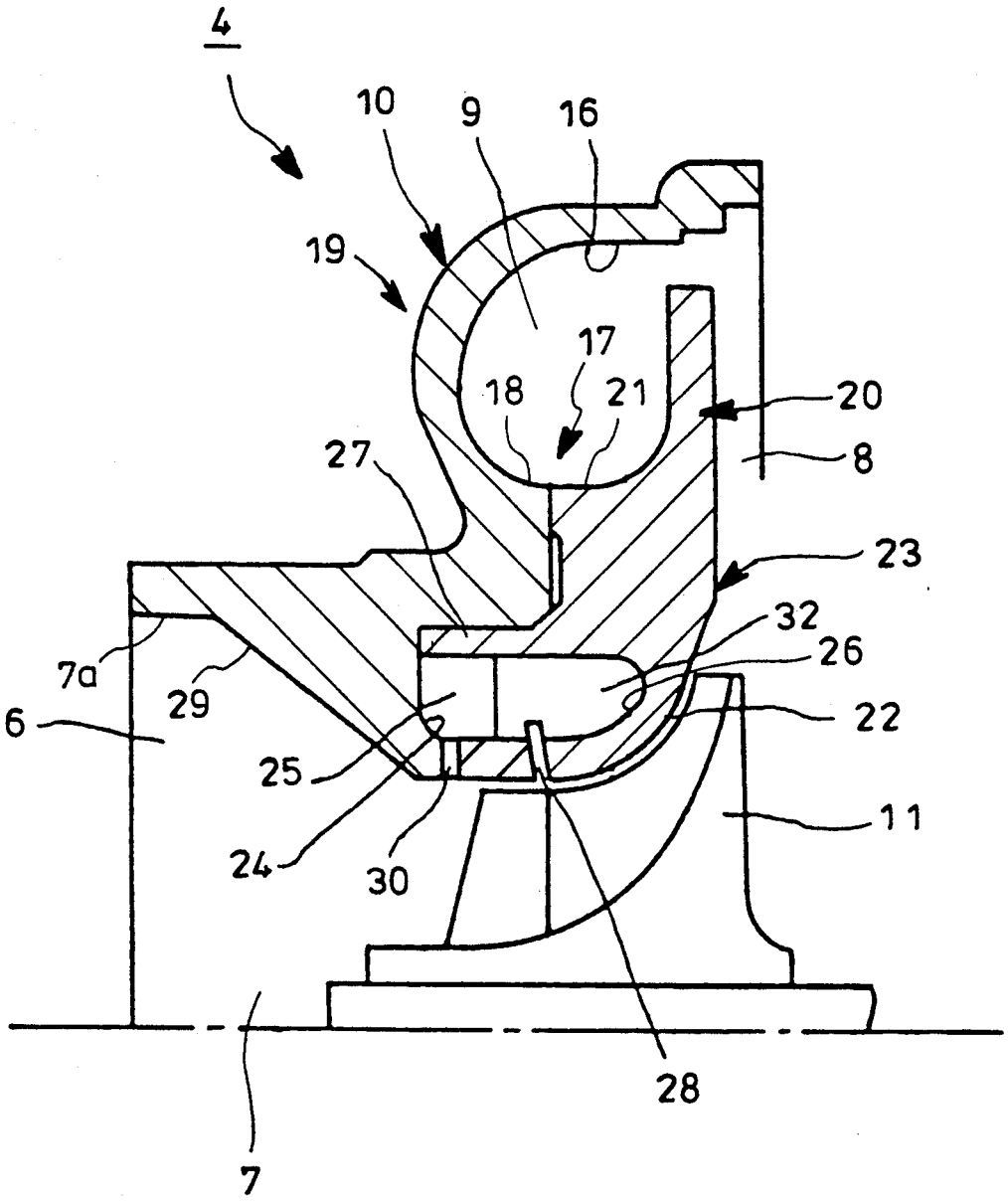

FIG. 5 illustrates a third embodiment of the present invention which is substantially similar in construction, mode of operation and features to the second embodiment described above with reference to FIG. 4 except that the first opening 28 is a hole or slit machined through the inner casing 23 while the second opening 30 is defined by the gap between the main body 19 and the inner casing 23.

A reinforcing rib 32 is formed in the recess 26 of the inner casing 23 to thereby minimize any deformations of the inner casing 23 under pressure upon shrinkage or cold fitting. In addition, the second opening 30 needs no reinforcing rib so that the transmission of vibrations to the impeller can be eliminated.

Figure 6:
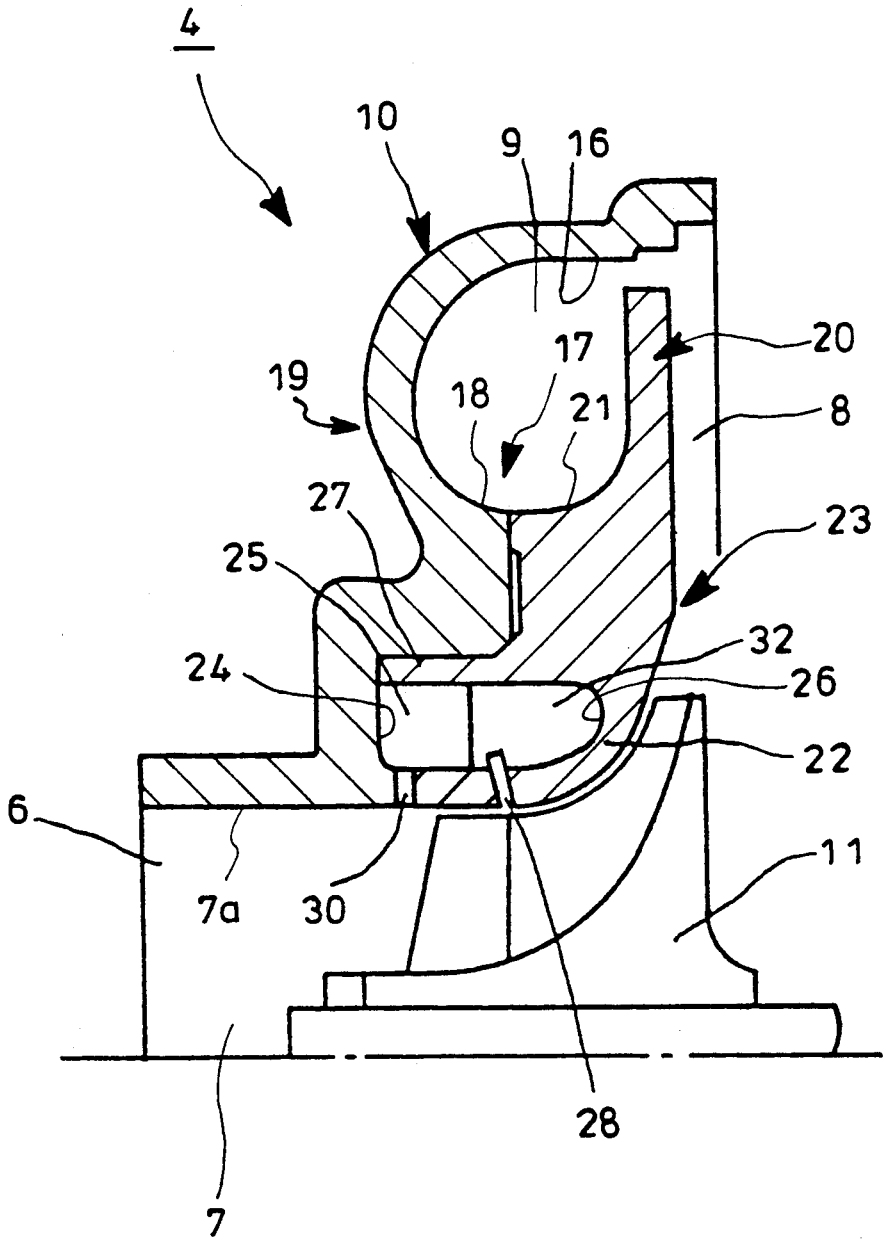

FIG. 6 illustrates a fourth embodiment of the present invention which is substantially similar in construction, mode of operation and features to the third embodiment except that the forth embodiment has no restriction 29.

Figure 7:
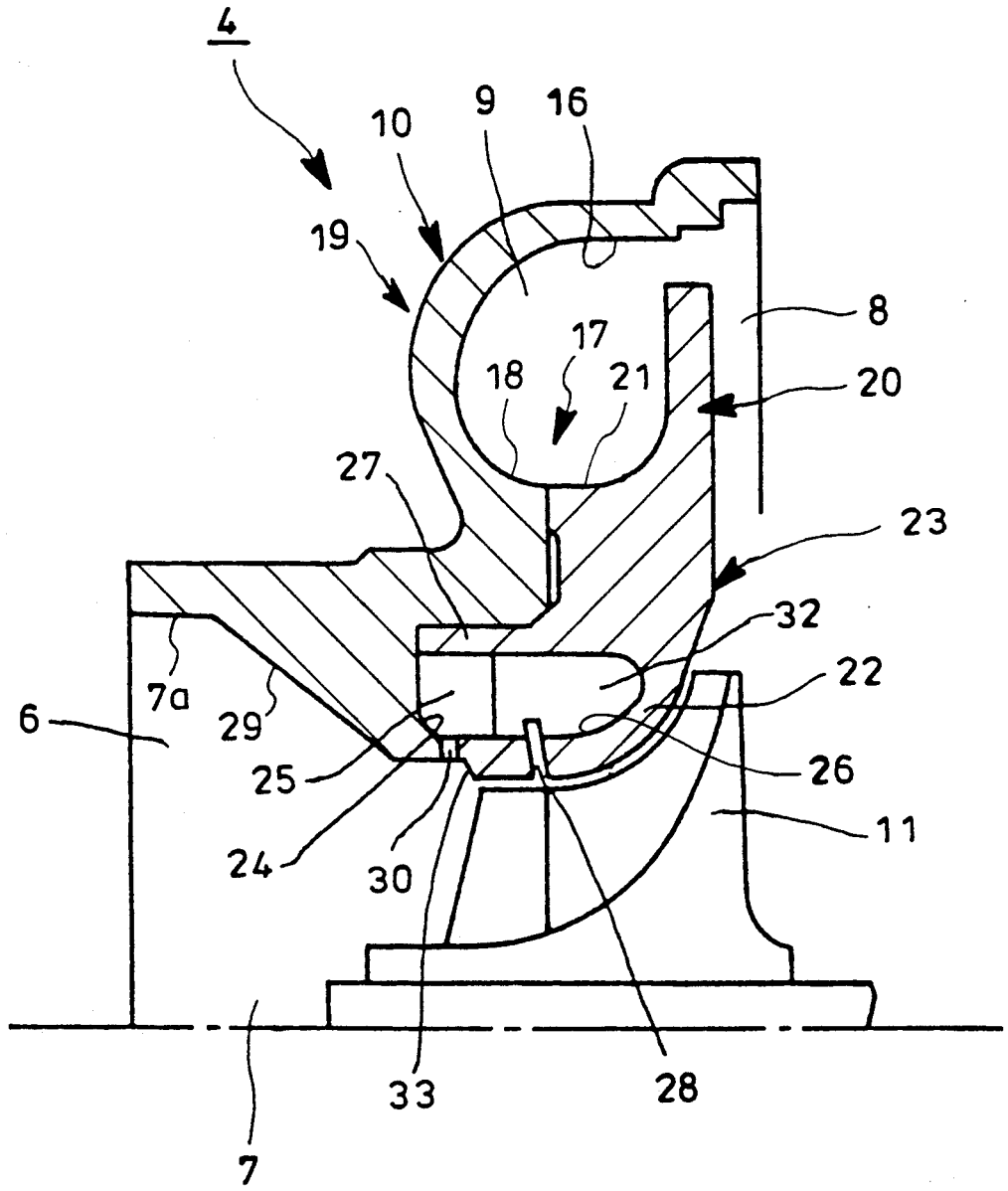

FIG. 7 illustrates a fifth embodiment of the present invention which is substantially similar in construction, mode of operation and features to the third embodiment except for a second restriction 33 between the first and second openings 28 and 30.

When the angle $\alpha$ of the first restriction 29 is increased so as to enhance the air flow convergence effect, the converged flow of the air 5 may not be sufficiently diverged back during its flow from the outlet of the first restriction 29 to the impeller 11. The second restriction 33 between the openings 29 and 30 serves to prevent this and facilitate divergence of the converged flow of the air 5 during its flow from the outlet of the first restriction 29 to the impeller 11, thereby avoiding adverse effects resulting from the insufficient divergence from the converged flow of the air 5 to further enhance the air convergent effect attained by the first restriction 29. As a result, the effect of displacing the surging-occuring range to the lower flow rate range can be further improved.

Figure 8:
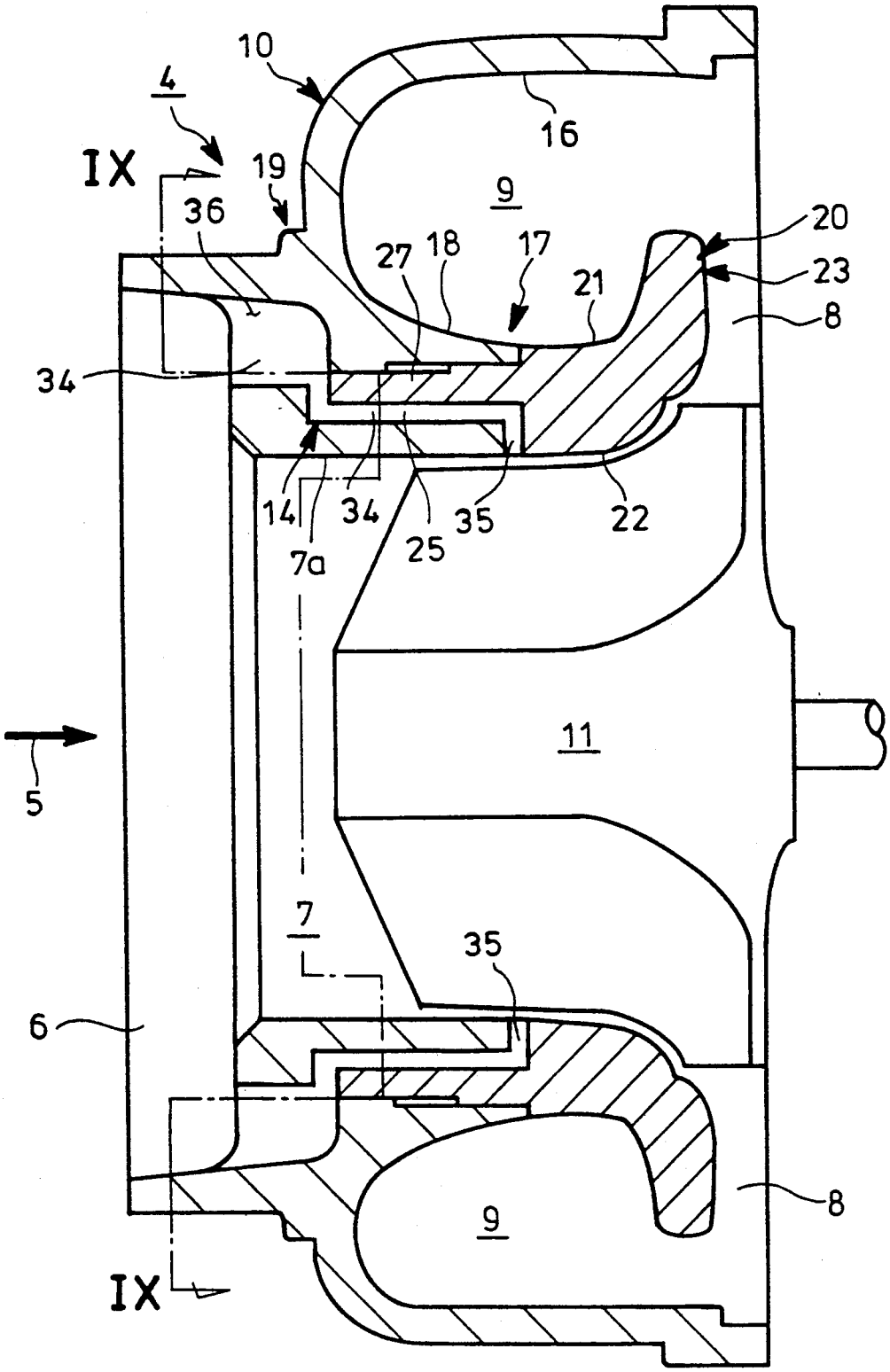
Figure 9:
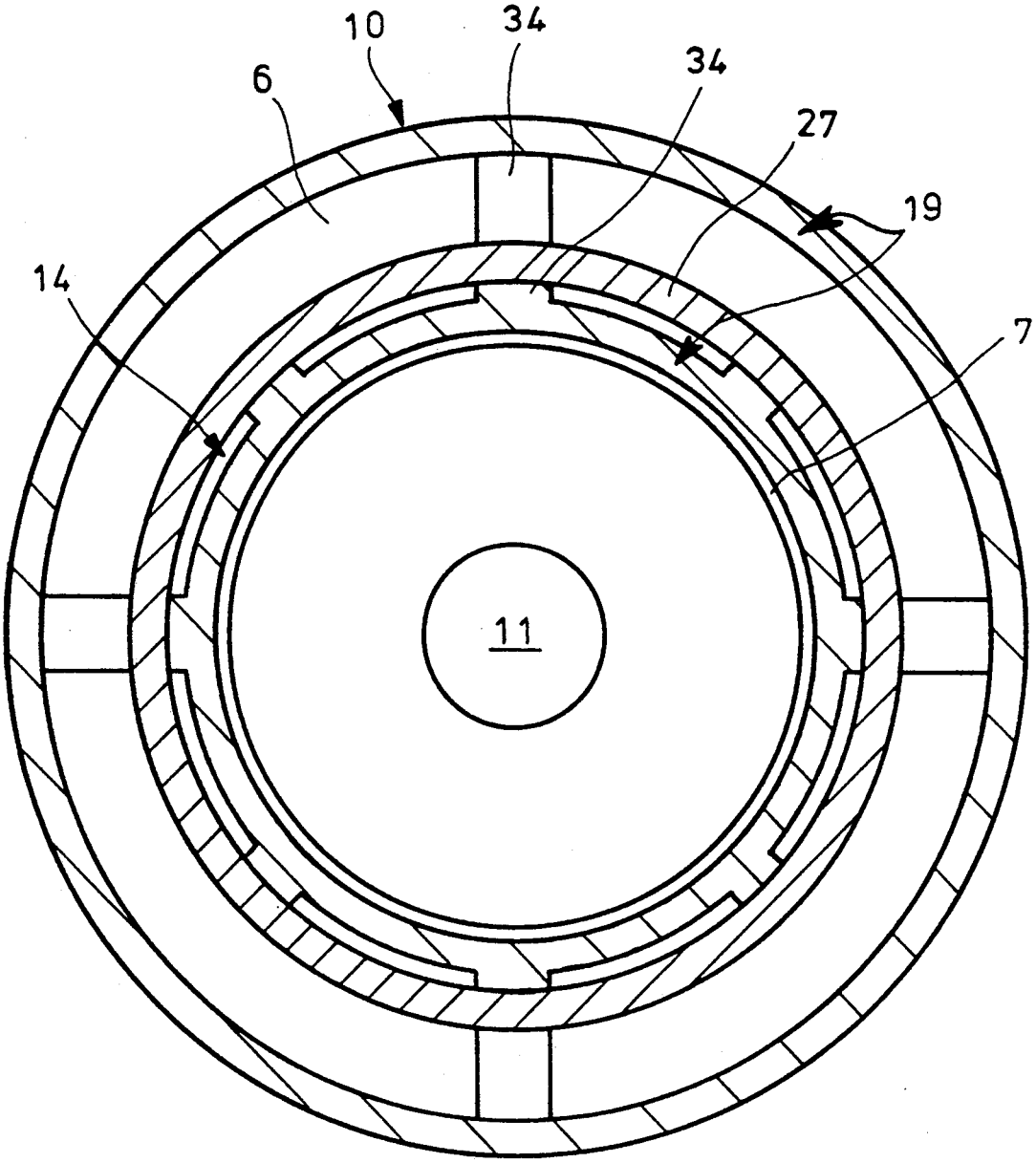
FIG. 9 is a sectional view taken along the line IX–IX of FIG. 8.

FIGS. 8 and 9 illustrate a sixth embodiment in which the concept of splitting or dividing the compressor casing 10 according to the present invention is applied to the conventional compressor casing shown in FIG. 2.

According to the sixth embodiment, the compressor casing 10 is divided into a casing main body 19 and an inner casing 23 which are relatively simple in construction so that the overall casting cost of the main body 19 and inner casing 23 can be lowered.

The main body 19 is fitted with the inner casing 23 to define an air passage 14 therebetween. As a result, no machining is needed after casting.

Reference numeral 34 denotes a reinforcing rib; 35, a first opening; and 36, a second opening.

Figure 10:
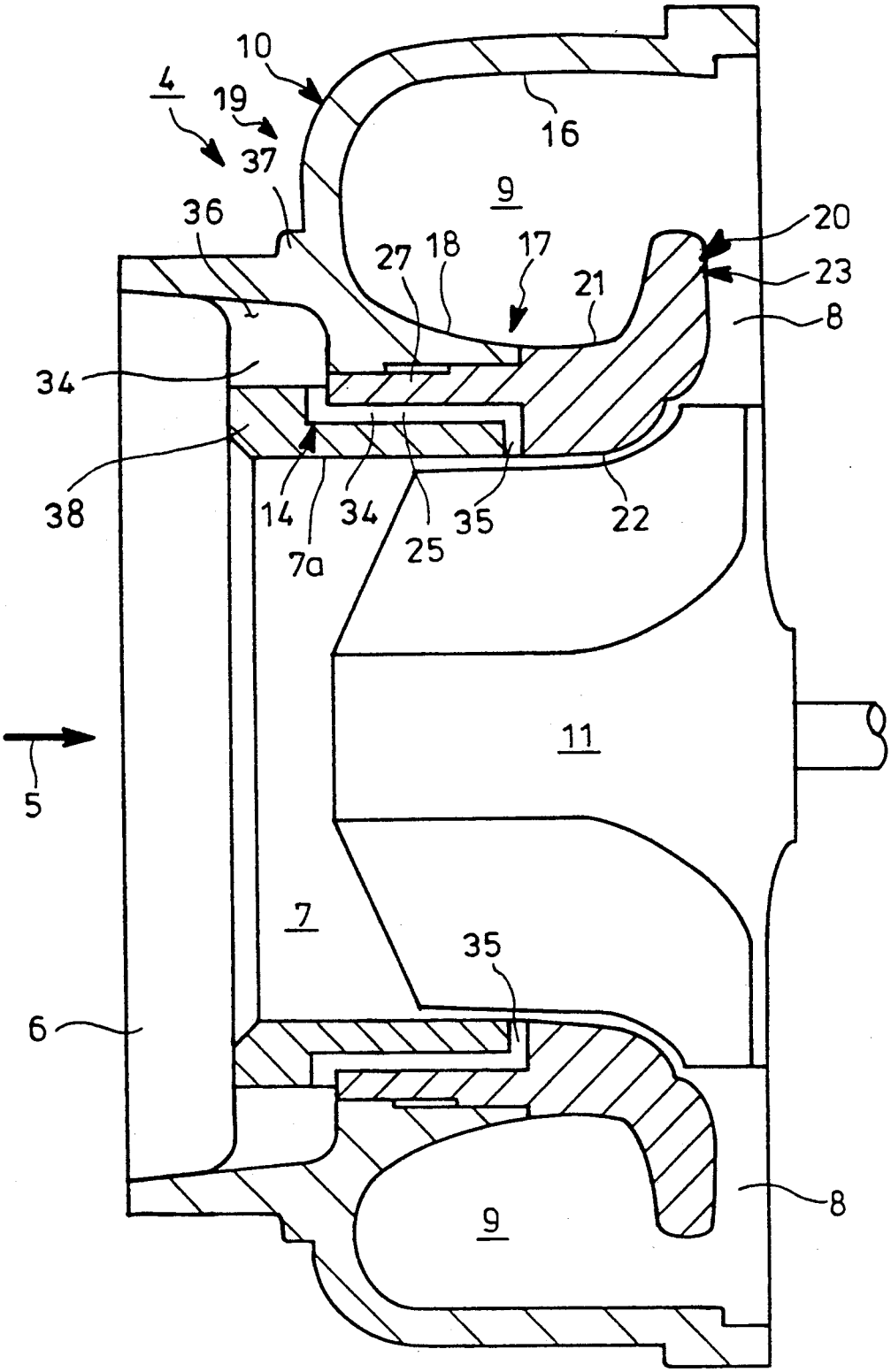
FIGS. 10 to 12 are partial longitudinal sectional views of seventh to ninth embodiments of the invention, respectively.

FIG. 10 illustrates a seventh embodiment of the present invention which is substantially similar in construction, mode of operation and features to the sixth embodiment described above except that the casing main body 19 is further divided into (A) an outer casing 37 with the air inlet port 6, the outer peripheral wall 16 of the scroll 9 and a portion 18 of the inner peripheral wall 17 of the scroll 9 and (B) a member 38 for defining an inlet-side portion 7*a* of the air intake passage 7.

Figure 11:
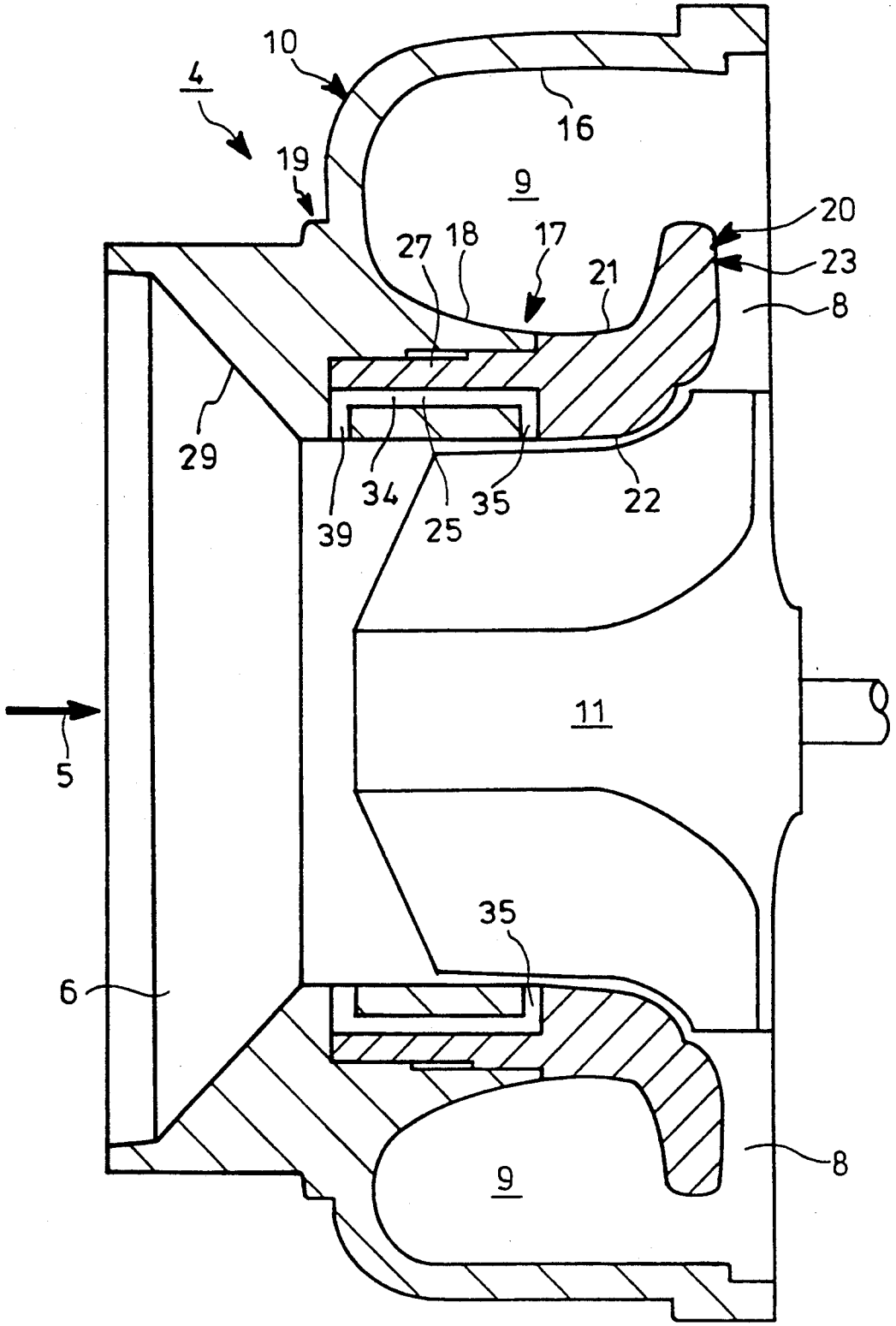

FIG. 11 illustrates an eighth embodiment of the present invention which is substantially similar in construction, effect and features to the sixth embodiment described above except that a second opening 39 extends radially of the impeller 11 to suck the air within the air passage 14 by the air 5 flowing through the air intake passage 7 so that the effect of displacing the surging-occuring range to a lower flow rate range is enhanced.

Figure 12:
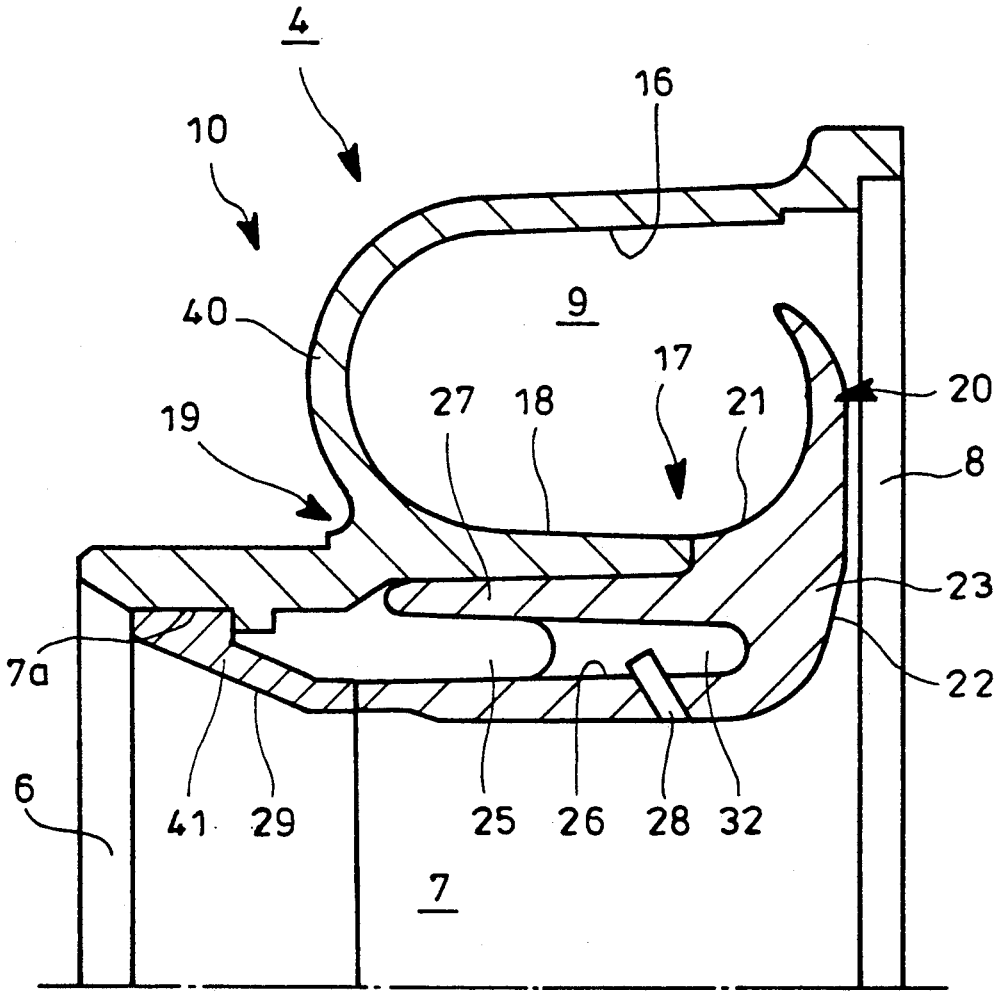
Figure 13:
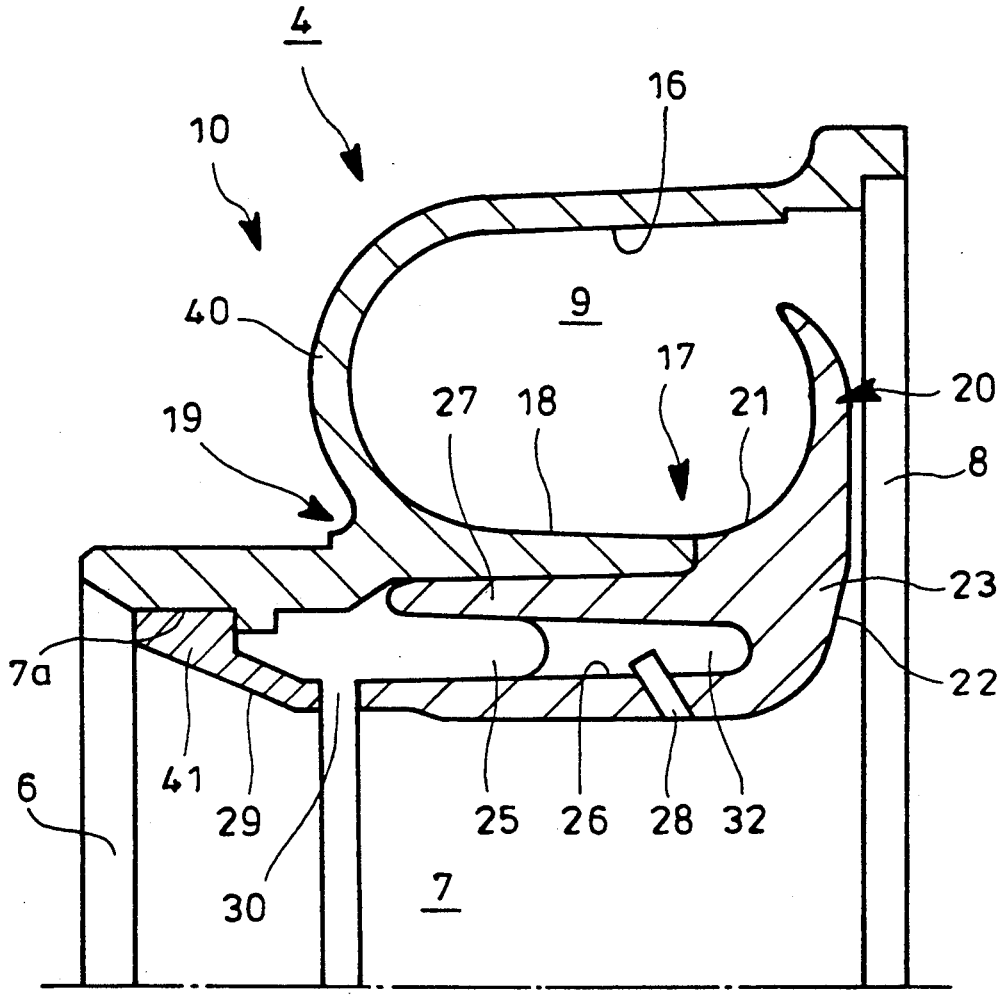
FIG. 13 is a partial longitudinal sectional view of a first modification thereof.
Figure 14:
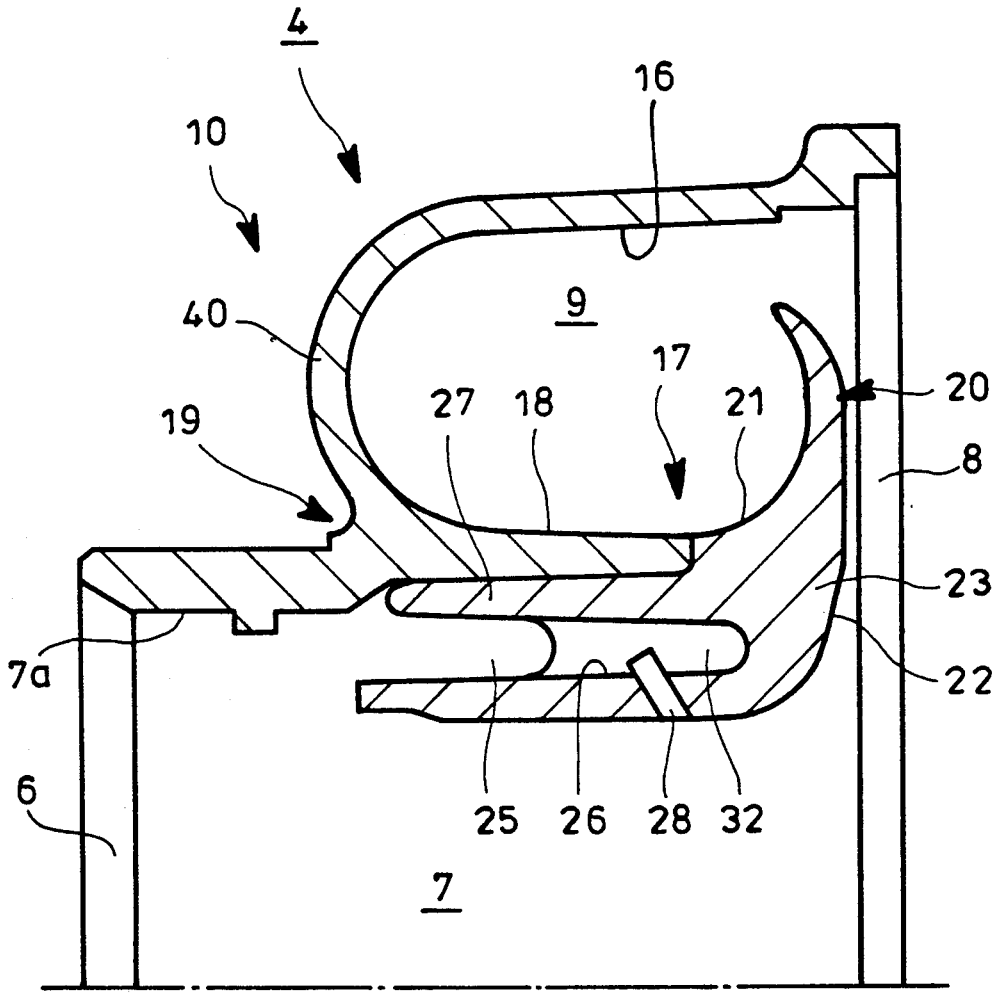
FIG. 14 is a partial longitudinal sectional view of a second modification thereof.

FIGS. 12–14 illustrate a ninth embodiment and its modifications which are similar in construction to the first embodiment shown in FIG. 3 except that the main body 19 is further divided into (A) an outer casing 40 with the air inlet port 6, the portion 7*a* of the air intake passage 7, the outer peripheral wall 16 of the scroll 9 and the portion 18 of the inner peripheral wall 17 of the scroll 9 and (B) a member 41 defining the restriction 29 of the air intake passage 7. To install the member 41 as shown in FIG. 12 will provide the compressor casing 10 substantially similar to that shown in FIG. 3. When the member 41 is installed with a gap being formed between the member 41 and the inner casing 23 as shown in FIG. 13, the compressor casing 10 with the second opening 30 like those shown in FIGS. 4 and 5 will be provided. In the case of the member 41 being omitted as shown in FIG. 14, the compressor casing 10 substantially similar to that shown in FIG. 8 will be provided.

It is to be understood that the present invention is not limited to the above-described embodiments and that various modifications may be effected without departing from the true spirit of the present invention. For instance, the components may be assembled not by fitting but by using screws.

As described above, a compressor casing for a turbocharger and an assembly thereof in accordance with the present invention can attain following remarkable features and advantages heretofore unattainable by the prior art:

(1) The effect of displacing the surging-occuring range to a lower flow rate range is considerably improved since a chamber or the like component is provided.

(2) The overall casting cost is remarkably lowered since the compressor casing is divided into a casing main body and an inner casing which are very simple in construction.

(3) No machining or the like is needed after casting since the inner casing is fitted into the casing main body to define a chamber or the like component therebetween.

What is claimed is:

1. In a compressor casing for a turbocharger having an air inlet port, an intake passage with an impeller accommodated therein, a diffuser and a scroll all communicated with each other in the order named, the improvement comprising an annular chamber between said passage and said scroll, said chamber having an opening which is disposed sideways of said impeller in said passage, a restriction defined by said intake passage at a position upstream of said opening, said restriction being gradually decreased in diameter from the air inlet port toward a wall of the diffuser, and a second restriction defined between said opening and said first restriction.

2. A compressor casing assembly for a turbocharger comprising a casing main body and an inner casing fitted with said main body along a mutual boundary, said main body defining an air inlet port, a portion of an air intake passage, an outer peripheral wall of a scroll and a portion of an inner peripheral wall of said scroll, said inner casing when fitted with said main body along said boundary defining a wall of a diffuser, a remaining portion of said inner peripheral wall of said scroll and a remaining portion of said air intake passage, and a chamber defined at the boundary of the fitted portions of said main body and said inner casing, said chamber having an opening which is disposed sideways of said impeller in said passage.

3. A compressor casing assembly for a turbocharger comprising a casing main body and an inner casing fitted with said main body along a mutual boundary, said main body defining an air inlet port, at least a portion of an air intake passage, an outer peripheral wall of a scroll and a portion of an inner peripheral wall of said scroll, said inner casing when fitted with said main body along said boundary defining a wall of a diffuser, a remaining portion of said inner peripheral wall of said scroll and a remaining portion of said air intake passage, a chamber between said main body and said inner casing at said boundary communication with said air intake passage, and an air discharge passage also defined at the boundary of said fitted portions of said main body and said inner casing communicating said chamber sideways of said impeller in said air intake passage with space adjacent to said air inlet port.

4. The assembly according to claim 2 wherein said casing main body itself is divided into an outer casing, and a member fitted with said outer casing, said outer casing defining said air inlet port, said outer peripheral wall of the scroll and said portion of said inner peripheral wall of the scroll, said member defining said portion of the air intake passage defined by said main body.

5. A compressor casing assembly for a turbocharger comprising a casing main body and an inner casing fitted with said main body, said main body defining an air inlet port, a portion of an air intake passage, an outer peripheral wall of a scroll and a portion of an inner peripheral wall of said scroll, said inner casing defining a wall of a diffuser, a remaining portion of said inner peripheral wall of said scroll, a remaining portion of said air intake passage and a recess with an opening communicated sideways of the impeller in the air intake passage and opened to said air inlet port, and a restriction-defining member selectively fitted with said main body such that said restriction-defining member closes said recess on the inner casing at the side adjacent to the air inlet port and defines a restriction decreased in diameter from said air inlet port toward said wall of the diffuser, said restriction-defining member being removable to connect said recess directly with said air inlet port.

* * * * *